US010244599B1

(12) United States Patent
Tyson et al.

(10) Patent No.: US 10,244,599 B1
(45) Date of Patent: Mar. 26, 2019

(54) WARM DIM CIRCUIT FOR USE WITH LED LIGHTING FIXTURES

(71) Applicant: Kichler Lighting LLC, Cleveland, OH (US)

(72) Inventors: Thomas Joseph Tyson, Cleveland, OH (US); Joseph John Janos, Phoenix, AZ (US)

(73) Assignee: Kichler Lighting LLC, Cleveland, OH (US)

( * ) Notice: Subject to any disclaimer, the term of this patent is extended or adjusted under 35 U.S.C. 154(b) by 0 days.

(21) Appl. No.: 15/809,020

(22) Filed: Nov. 10, 2017

Related U.S. Application Data

(60) Provisional application No. 62/420,198, filed on Nov. 10, 2016.

(51) Int. Cl.
*H05B 37/00* (2006.01)
*H05B 33/08* (2006.01)

(52) U.S. Cl.
CPC ..... *H05B 33/0857* (2013.01); *H05B 33/0824* (2013.01)

(58) Field of Classification Search
CPC ..... H05B 33/0857; H05B 33/0824
USPC ..... 315/193
See application file for complete search history.

(56) References Cited

U.S. PATENT DOCUMENTS 6,340,868 B1 1/2002 Lys et al.
6,577,080 B2 6/2003 Lys et al.
6,897,624 B2 5/2005 Lys et al.
6,936,978 B2 8/2005 Morgan et al.
6,967,448 B2 11/2005 Morgan et al.
7,031,920 B2 4/2006 Dowling et al.
7,132,785 B2 11/2006 Ducharme
7,186,003 B2 3/2007 Dowling et al.
7,221,104 B2 5/2007 Lys et al.
7,248,239 B2 7/2007 Dowling et al.
7,253,566 B2 8/2007 Lys et al.
7,352,138 B2 4/2008 Lys et al.
7,427,840 B2 9/2008 Morgan et al.
7,453,217 B2 11/2008 Lys et al.
7,525,254 B2 4/2009 Lys et al.
7,550,931 B2 6/2009 Lys et al.
7,703,943 B2 4/2010 Li et al.
7,845,823 B2 12/2010 Muellet et al.
7,883,226 B2 2/2011 Li
7,915,627 B2 3/2011 Li
8,142,051 B2 3/2012 Ducharme
8,147,081 B2 4/2012 Mrakovich et al.
8,188,502 B2 5/2012 Li
8,203,260 B2 6/2012 Li et al.
8,212,469 B2 7/2012 Rains, Jr. et al.
8,322,896 B2 12/2012 Falicoff et al.
8,338,849 B2 12/2012 Tischler et al.
8,384,114 B2 2/2013 Tischler et al.
(Continued)

FOREIGN PATENT DOCUMENTS

WO 2015183810 12/2015

*Primary Examiner* — Don Le
(74) *Attorney, Agent, or Firm* — Brooks Kushman P.C.

(57) ABSTRACT

A system for and method of regulating the current through a string of LEDs using differential current regulating circuits such that certain segments of the string produce more light output than other segments to regulate the color temperature of the total light output by the string such that a warm dim function may be enabled.

20 Claims, 11 Drawing Sheets

(56) References Cited

U.S. PATENT DOCUMENTS 8,414,151 B2 4/2013 Allen et al.
8,450,759 B2 5/2013 Cheng
8,456,109 B1 6/2013 Wray
8,466,611 B2 6/2013 Negley et al.
8,545,033 B2 10/2013 Gielen et al.
8,562,161 B2 10/2013 Tong et al.
8,581,520 B1 11/2013 Wray
8,598,809 B2 12/2013 Negley et al.
8,604,678 B2 12/2013 Dai et al.
8,604,684 B2 12/2013 Pickard
8,610,341 B2 12/2013 Dai et al.
8,614,539 B2 12/2013 Dai et al.
8,632,196 B2 1/2014 Tong et al.
8,680,544 B2 3/2014 Wang
8,686,449 B2 4/2014 Li
8,729,589 B2 5/2014 Hussell et al.
9,198,242 B2 * 11/2015 Chu ..... H05B 33/083
9,241,384 B2 1/2016 van de Ven et al.
9,380,671 B1 6/2016 Janos et al.
9,482,397 B2 11/2016 Grajcar
9,807,835 B1 10/2017 Janos et al.
2006/0050509 A9 3/2006 Dowling et al.
2007/0228931 A1 10/2007 Kim et al.
2010/0052560 A1 3/2010 Li et al.
2011/0128718 A1 6/2011 Ramer et al.
2011/0204805 A1 8/2011 Li et al.
2011/0215701 A1 9/2011 Tong et al.
2011/0227102 A1 9/2011 Hussell et al.
2012/0056543 A1 * 3/2012 Yang ..... H05B 33/089
315/120
2012/0140435 A1 6/2012 Li et al.
2012/0155076 A1 6/2012 Li et al.
2012/0223632 A1 9/2012 Hussell et al.
2012/0223657 A1 9/2012 Van de Ven
2012/0224363 A1 9/2012 Van De Ven
2012/0229032 A1 9/2012 Van De Ven et al.
2012/0262902 A1 10/2012 Pickard et al.
2012/0281387 A1 11/2012 Tung et al.
2012/0286646 A1 11/2012 Sakuta et al.
2012/0287601 A1 11/2012 Pickard et al.
2012/0306370 A1 12/2012 Van De Ven et al.
2012/0306375 A1 12/2012 Van De Ven
2013/0003346 A1 1/2013 Letoquin et al.
2013/0009179 A1 1/2013 Bhat et al.
2013/0027904 A1 1/2013 Fan
2013/0050979 A1 2/2013 Van De Ven et al.
2013/0051002 A1 2/2013 Draper et al.
2013/0051003 A1 2/2013 Fan
2013/0093362 A1 4/2013 Edwards
2013/0094176 A1 4/2013 Deeman et al.
2013/0094177 A1 4/2013 Edwards
2013/0094178 A1 4/2013 Huang et al.
2013/0170175 A1 7/2013 Negley et al.
2013/0181619 A1 7/2013 Tischler et al.
2013/0208457 A1 8/2013 Durkee et al.
2013/0229104 A1 9/2013 Green et al.
2013/0235557 A1 9/2013 Hadrath et al.
2013/0279151 A1 10/2013 Ouderkirk et al.
2013/0306998 A1 11/2013 Ulasyuk
2013/0320834 A1 12/2013 Ulasyuk
2013/0334956 A1 12/2013 Bretschneider
2014/0003048 A1 1/2014 Tong et al.
2014/0021493 A1 1/2014 Andrews et al.
2014/0049172 A1 2/2014 Bakk
2014/0361696 A1 * 12/2014 Siessegger ..... H05B 33/0803
315/186
2016/0212811 A1 * 7/2016 Cheng ..... H05B 33/083

* cited by examiner

WARM DIM CIRCUIT FOR USE WITH LED LIGHTING FIXTURES

RELATED APPLICATION

The present application is being filed as a non-provisional patent application claiming priority/benefit under 35 U.S.C. § 119(e) from U.S. Provisional Patent Application No. 62/420,198 filed on Nov. 10, 2016, the entire disclosure of which is incorporated herein by reference.

TECHNICAL FIELD

This relates generally to systems for controlling light emitting diode (LED) lighting fixtures using a warm dimming process to regulate the illumination provided by strings of LEDs.

BACKGROUND

LED lighting fixtures are increasingly popular alternatives to traditional incandescent and compact florescent lighting. This is likely because of the increased efficiency and much longer life afforded by LEDs when compared to incandescent and even compact florescent alternatives.

However, despite the benefits of LED-based lighting, LED's are more difficult to dim than traditional incandescent lighting. In particular, LED fixtures (which, as used herein, could also refer to LED bulbs for insertion into lamps or lighting devices), generally constructed of a plurality of individual LEDs, are subject to flicker, pixilation (the effect of individual LEDs being visible to an observer of the fixture), and the lack of changes in the color or warmth of the light provided by the fixture as the light output of the LEDs is reduced. Exemplary known systems employ pulse width modulation (PWM) techniques to regulate LEDs strings to produce a dimming effect. However, dimming produced using PWM regulation circuitry is subject to lighting abnormalities and issues with the quality of light produced by the LED. What is needed is a system and method for controlling the output of LED lighting fixtures that applies a warm dimming technique to improve the lighting characteristics as the fixture is dimmed while retaining the efficiency inherent in LED lighting.

SUMMARY

Embodiments of the invention comprise current regulation circuitry that is configured to selectively dim portions of a string of LEDs used in a light fixture. These portions may be comprised of groups of LEDs that exhibit a particular color temperature and are regulated such that the light output and the color temperature of the fixture may be selectively and independently adjusted. In an exemplary embodiment, a string comprising a plurality of LEDs is provided with a voltage source and a constant current source. The exemplary embodiment also comprises at least one differential current regulation circuit connected in parallel with at least a portion of the string of LEDs such that the differential current regulating circuit can increase or decrease the light output of the portion with which the differential current regulating circuit is in parallel.

In an exemplary embodiment, a warm dim circuit comprises at least first and second pluralities of LEDs electrically connected in series between a voltage source and a current source. The exemplary embodiment also comprises a dimmable LED segment controller configured to illuminate and independently dim at least one of the pluralities of LEDs, a lighting control unit that is in communication with the dimmable LED segment controller. The dimmable LED segment controller comprises a differential current regulation circuit that dims the plurality of LEDs.

In another exemplary embodiment, warm dimming of a string of LEDs is accomplished by arranging a string of LEDs comprising a plurality of segments formed from LEDs with a similar color temperature. A voltage source is provided to the string and an adjustable constant current source is connected in series with the string. A differential current regulation circuit is connected in parallel with at least one of the plurality of segments and controlled by a control signal such that the current through the segment is regulated to adjust the brightness of the segment. In such an embodiment, the constant current source is controlled by a current source control signal which adjusts the current through the string of LEDs to further control the brightness of the LEDs which are comprised be the string.

In still another embodiment of the invention, a warm dim circuit comprises at least first, a second, and a third plurality of LEDs electrically connected in series with a voltage source and a current source. The color temperature of the first plurality of LEDs is cooler than that of the second plurality and the color temperature of the second plurality is cooler than that of the third plurality. The exemplary embodiment also comprises a first dimmable LED segment controller configured to illuminate and independently dim the first plurality of LEDs and a second dimmable LED segment controller configured to illuminate and independently dim the second plurality of LEDs. The exemplary embodiment comprises a control unit that is in communication with the dimmable LED segment controller where the control unit comprises an algorithm that dims the first plurality of LEDs, then the second plurality of LEDs and then causes the current source to reduce the current through the third plurality of LEDs in order to simulate a warm dimming effect.

The above and other aspects and advantages of the general inventive concepts will become more readily apparent from the following description and figures, illustrating by way of example the principles of the general inventive concepts.

BRIEF DESCRIPTION OF THE DRAWINGS

These and other features of the general inventive concept will become better understood with regard to the following description and accompanying drawings in which.

DETAILED DESCRIPTION

This Detailed Description merely describes exemplary embodiments of the invention and is not intended to limit the scope of the claims in any way. Indeed, the invention as claimed is broader than and unlimited by the preferred embodiments, and the terms used in the claims have their full ordinary meaning.

Color temperature when used with regard to lighting refers to the appearance of the light produced. Generally, these color temperatures are referred to in units of degrees kelvin (K). Color temperatures with higher numbers (i.e., 5000K) are more blue-white and are referred to as "cooler" colors. Color temperatures with lower numbers (i.e., 2700K) are more yellow or reddish-white and are known as "warmer" colors. Depending upon the application, a lighting fixture can be configured to produce a color between the cooler and warmer colors. As used herein, the term "warm dimming" refers to a shift from cooler colors to warmer colors as a lighting fixture is caused to dim in brightness. Incandescent lamps generally exhibit warm dimming as a natural result of the filament cooling as the lamp output is reduced. Because of familiarity with the characteristics of incandescent lighting, and warm dimming simulates the twilight dimming of an actual sunset, this characteristic is a desirable lighting attribute in many contexts.

LED fixtures generally do not naturally exhibit a warm dimming characteristic due to the relatively fixed color output produced by LEDs. In order to simulate this characteristic, LEDs having varied color outputs are combined in various intensity ratios.

Exemplary embodiments of the invention disclosed herein utilize a novel method of producing a warm dimming effect in LED fixtures. Such embodiments achieve this effect using a combination of LED segments of various color temperatures. As used herein, an LED "segment" is a subset of an LED string. These segments are regulated by a novel differential current circuit, which will now be described in detail.

Figure 1:
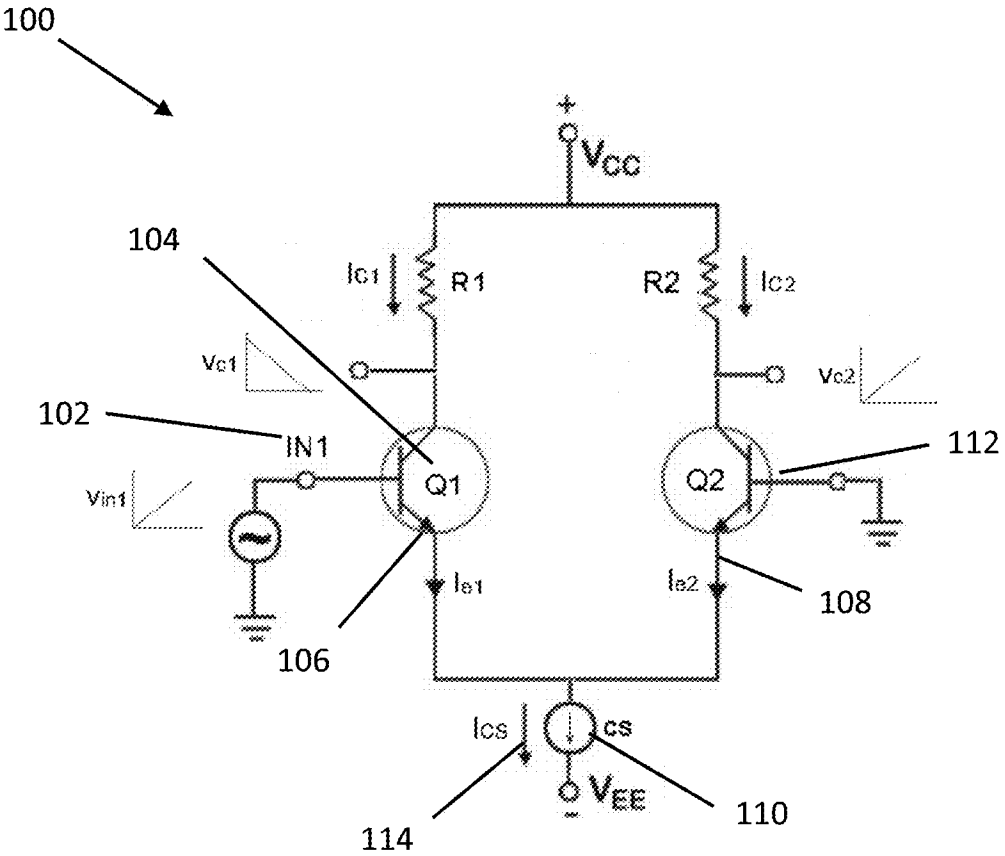
FIG. 1 a circuit diagram of a known embodiment of a differential amplifier.

An exemplary embodiment is shown in FIG. 1. In the circuit 100 of FIG. 1, when a positive value is applied to IN1 (Q1 base) 102, of transistor Q1 104, the current at Q1 emitter 106 will rise concurrently. As a result, the voltage of the emitter will rise relative to the Q1 base 102. Because the Q1 emitter 106 is tied to the Q2 108 emitter at the current source 110, it follows that the voltage at the Q2 emitter will equate to that of the Q1 emitter 106. Thus, raising Q2 emitter 108 with respect to Q2 base 112 is the same as lowering Q2 base with respect to a fixed Q2 emitter. As a result, changes in one transistor are reflected in the other and appear in the respective emitters. Additionally, since Q1 emitter 106 is joined to Q2 emitter 108, the currents through Q1 104 and Q2 112 will sum and equal the current, Ics 114, provided by the current source 110. This relationship is represented by:

$$Ics=Ie1+Ie2$$

Because the current provided by the current source 110 is a constant, the above equation can be rewritten as:

$$\text{Constant Current}=Ie1+Ie2$$

Or $$Ie2=\text{Constant Current}-Ie1$$

Thus, any change in Q1 104 current is reflected in Q2 112 current. Thus, it can be concluded that in a design such as illustrated in FIG. 1, where two devices (104 and 112) are coupled thru a current source 110, a changing input current 102 to one device will cause a representative response in the other device.

Figure 2:
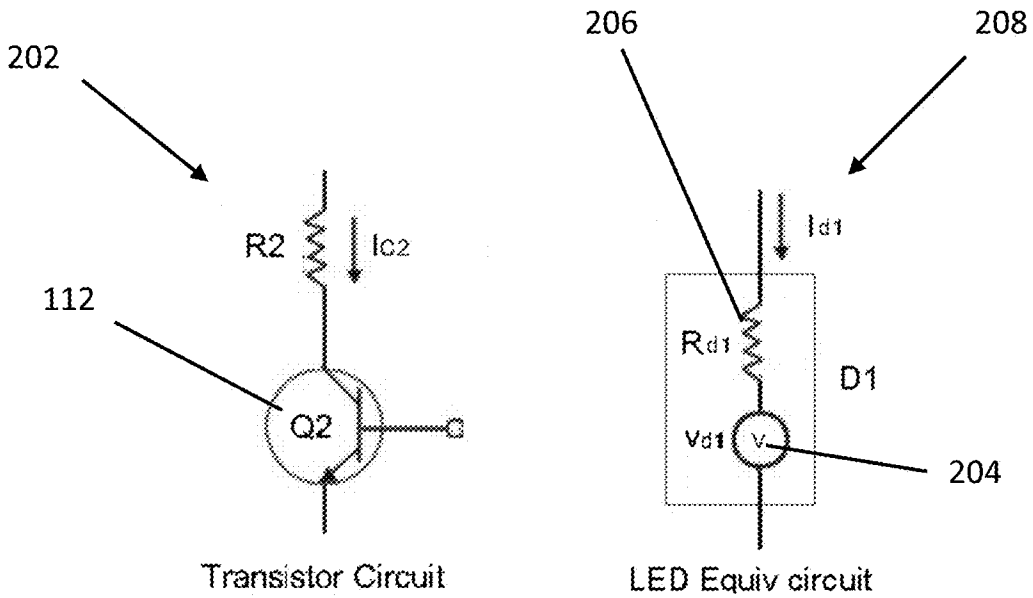
FIG. 2 is a circuit diagram of an equivalent circuit to a portion of the amplifier of FIG. 1.

This effect can be applied to control the output of an LED string by affecting the current flow thru the string. As is illustrated in FIG. 1, and described herein, changing current in one device will affect a change in the other device when those devices are coupled in conjunction with a current source. FIG. 2 illustrates the Q2 112 portion 202 of FIG. 1. In an exemplary embodiment, this portion 202 is replaced with an LED string (or multiple strings in parallel). The equivalent circuit for a LED can be represented as a voltage source, Vd1 204, in series with a resistor, Rd1 206, which is illustrated at 208. The voltage source value, Vd1 204, is equivalent to the forward drop of an LED or string of LEDs. In order for the LED(s) to illuminate, the power source voltage across the string must be greater than Vd1 204 in order to cause current to flow thru the internal resister, Rd1 206. Once current begins to flow, the light output of the LED(s) is then a function of the current thru Rd1 206. The greater the current, the greater the lumen output up to the point at which the solid-state structure of the LED cannot support supplied current and the LED fails. Conversely, a reduction in current thru Rd1 206 causes a reduction in light output of the LED to the point where no current flows and the LED turns off.

Figure 3:
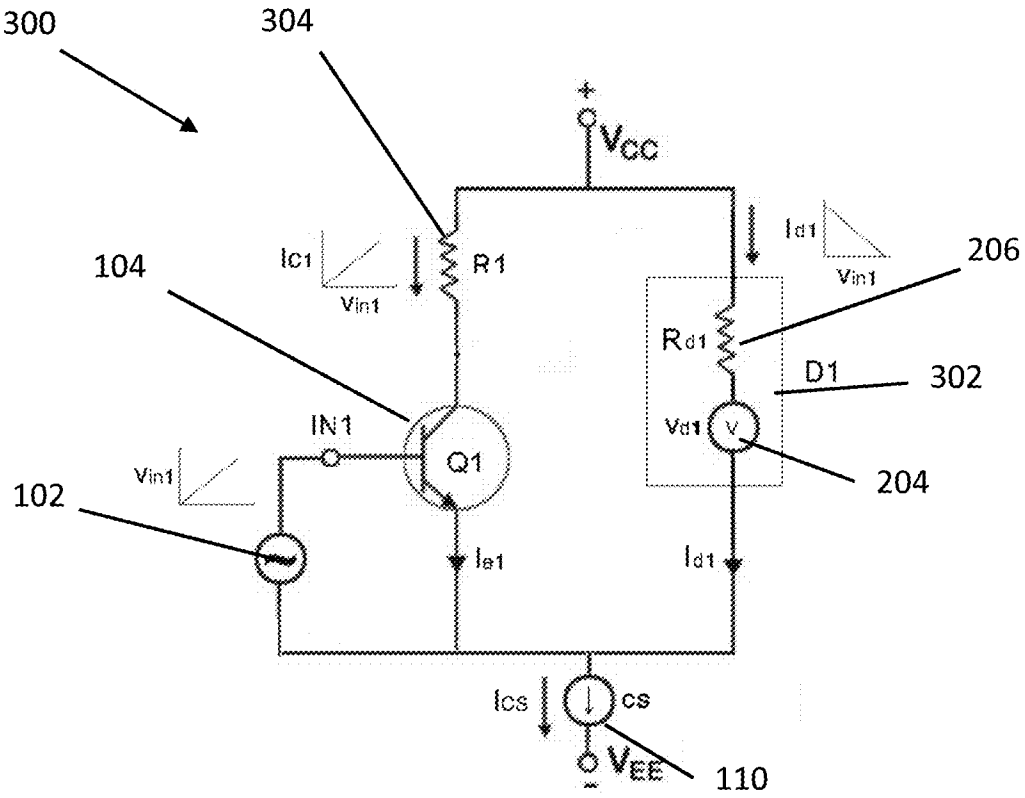
FIG. 3 is a differential current control circuit according to an exemplary embodiment.

FIG. 3 illustrates a differential current circuit 300 incorporating one or more LEDs configured in a series string represented by D1 302. As was the case in the circuit 100 of FIG. 1, the current thru the current source 110 is shared by Q1 104 and D1 302 and is represented by:

$$Ics=Ie1+Id1$$

The current that flows through the current source 110 is essentially constant provided the current source is operated within its linear range. Therefore, the current in D1 302 representing the LED can be defined by:

$$\text{const}-Ie1=Id1$$

As noted above, the light output of D1 302 is a function of the current through D1. It can be concluded from the above equation that the current through D1 302 can be controlled by affecting the value of Ie1. Because the value of Ie1 is varied by changing the input value to Q1 104 at IN1 102, it can be inferred that the input value to Q1 controls the current through D1 and thus its light output.

The current source 110 and R1 304 can be selected to enable a desired light output range. The current source 110 current value Ics is selected by turning Q1 104 off (removing the current supplied at IN1 102) and adjusting Ics for peek light output at D1 302. R1 304 is then selected such that when the voltage applied to the base of Q1 (Vin1) is at its maximum value, the current thru R1 304 is equal to Ics, thereby depriving Rd1 206 of any current (or any desired operating point between full illumination and off).

In an exemplary embodiment, warm dimming is achieved by combining a plurality of separate warm white LED segments, each with a warmer color temperature than the previous segment, into a string. The combined color temperature and light output of the segments results in the desired light output and color temperature when the string is fully illuminated. In order to warm dim such a configuration, the coolest color temperature LED segment is dimmed followed by the next coolest color temperature LED segment and so-on until it all LEDs in the string are dimmed to the desired light output level. In an exemplary embodiment with three segments of LEDs, the final segment is comprised of 2200K LEDs that dim from approximately 15% maximum light output down to shut-off.

In exemplary embodiments, the LED segments of different colors are physically arranged on a circuit board or other carrier in concentric "rings" or loci of LEDs, e.g., two, three, or four concentric "rings" or loci of LEDs. In some exemplary systems, three concentric rings or loci of LEDs are used: four inner LEDs, nine middle LEDs, and seven outer LEDs. In some exemplary embodiments, the outer (e.g., 7) LEDs are 4000K, the middle (e.g., 9) LEDs are 2700K, and the center (e.g., 4) LEDs are 2200K. In exemplary embodiments, the outer (e.g., 7) LEDs are just inside a circle that is about 1⅛", e.g., 1.14" in diameter, the middle (e.g., 9) LEDs are just inside a circle that is about three quarters of an inch, e.g., 0.83" in diameter, and the center (e.g., 4) LEDs are just inside a circle that is about a half inch, e.g., 0.51" in diameter. Thus, each locus of LEDs forms an n-sided polygon ("n-gon") that fits just inside a correspondingly sized circle. In exemplary dimming embodiments simulating an incandescent light bulb being dimmed, one starts by dimming the coolest correlated color temperature (CCT) LEDs (e.g., 4000K) until they are off, then dimming the next coolest CCT LEDs (e.g., 2700K) until they are off, then dimming the inner (e.g., 4) 2200K LEDs from approximately 15% down to shut-off.

Figure 4:
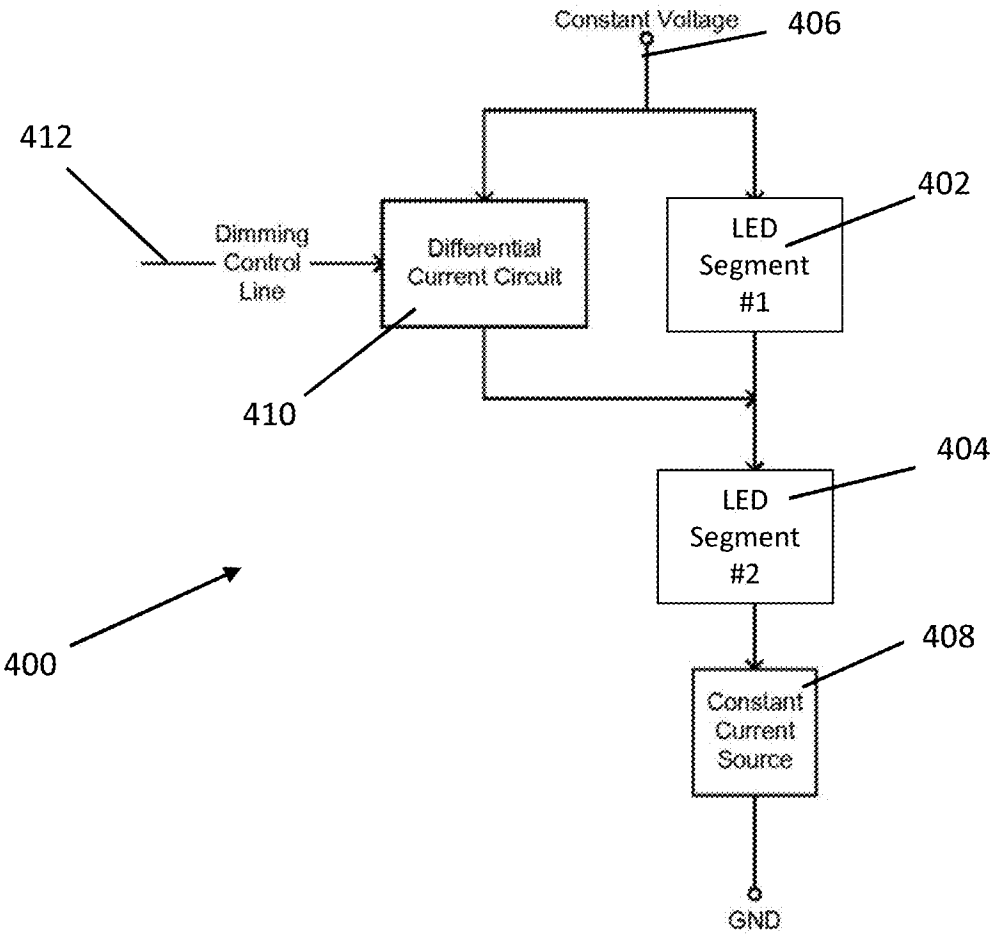
FIG. 4 is a circuit diagram of a LED light output regulation circuit according to an exemplary embodiment of the invention.
Figure 5:
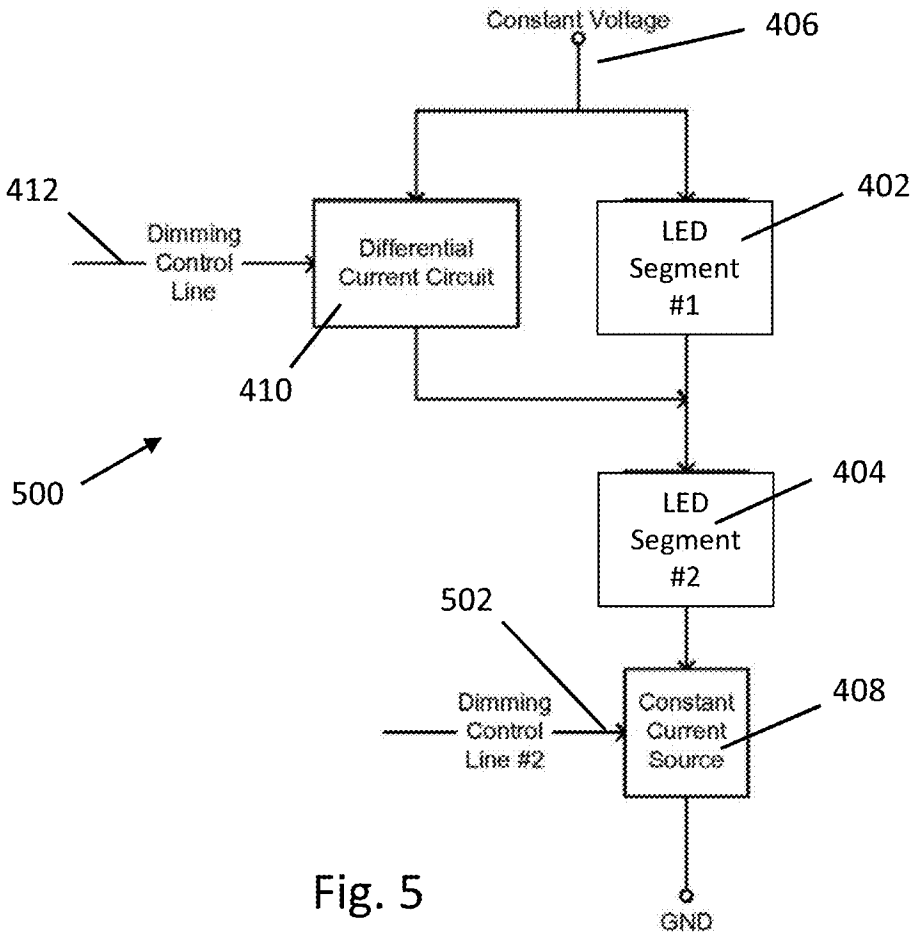
FIG. 5 is a circuit diagram of a LED light output regulation circuit according to an exemplary embodiment of the invention.
Figure 6:
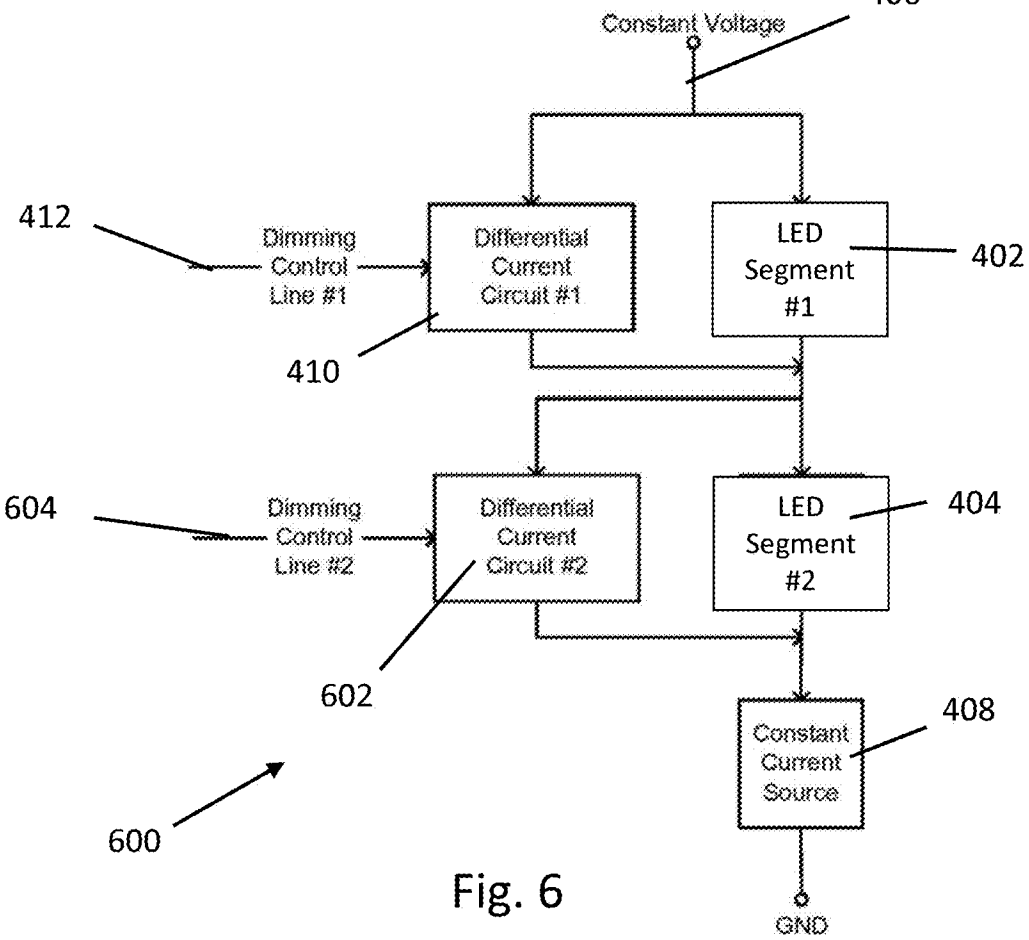
FIG. 6 is a circuit diagram of a LED light output regulation circuit according to an exemplary embodiment of the invention.
Figure 7:
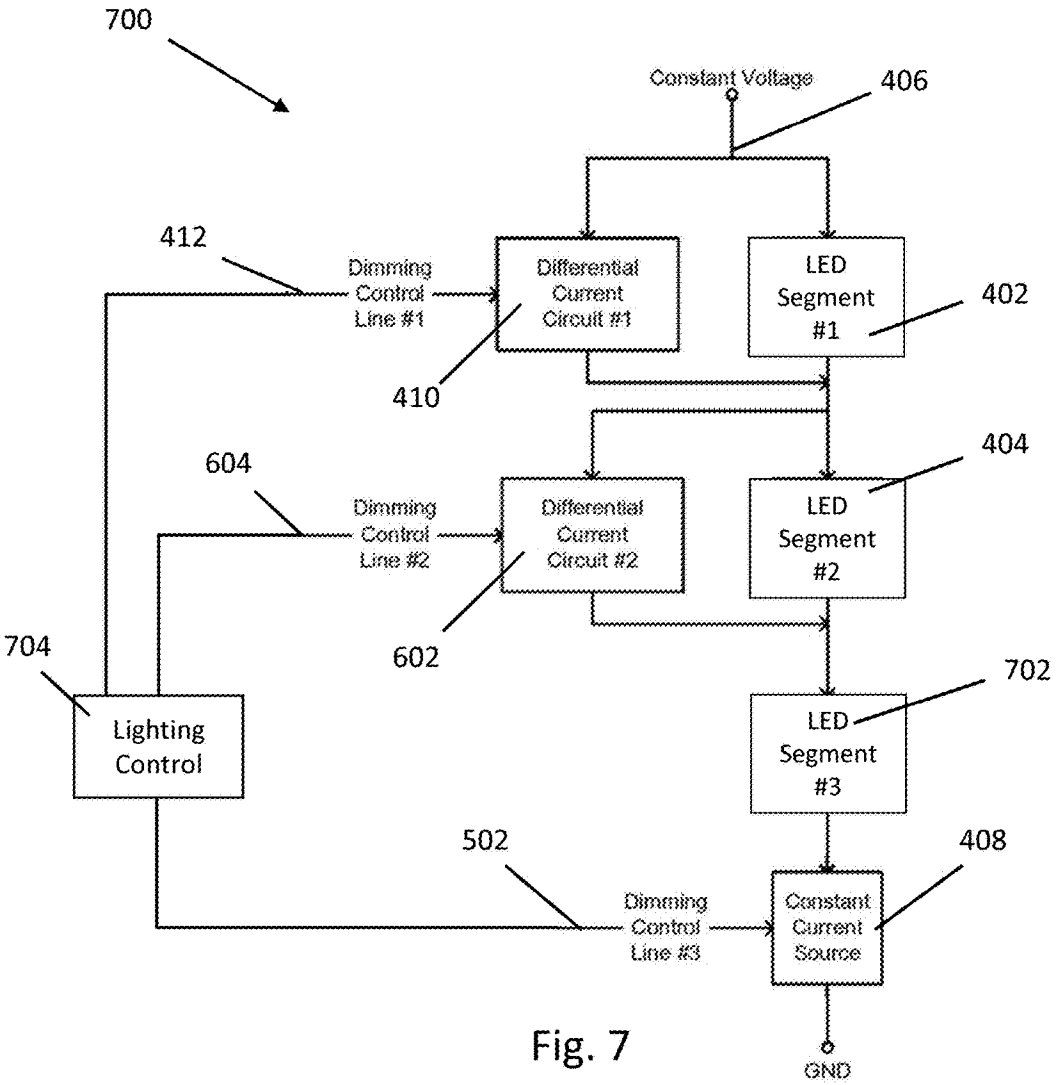
FIG. 7 is a circuit diagram of a LED light output regulation circuit according to an exemplary embodiment of the invention.

Exemplary circuits that embody the differential current circuit described herein are shown in FIGS. 4-7. FIG. 4 illustrates a warm dimming LED circuit 400 comprising a first 402 and second 404 segment of LEDs electrically connected in series between a voltage source 406 and a constant current source 408; and a differential circuit LED segment controller 410 configured to illuminate and independently dim the first segment of LEDs by diverting current from the first string of LEDs in response to a first control signal 412. In exemplary embodiments, the various control signals herein are provided by a lighting control unit 704, e.g., a preprogrammed processor, such as a microcontroller, or other logic. Such an embodiment is illustrated in FIG. 7. Although not illustrated in FIGS. 4-6, a lighting control unit 704 (e.g., a processor pre-programmed with code to perform the various functions and methods herein) could also be employed in those and other embodiments to control the light output from the various LED segments which make up a dimmable LED light string. In exemplary embodiments, digital control signals can be output directly by a digital output of the lighting control unit 704. In other exemplary embodiments, analog control signals can be output directly by an analog output of the lighting control unit 704 (or via other circuitry external to the lighting control unit, e.g., a digital-to-analog converter).

"Logic," synonymous with "circuit" as used herein includes, but is not limited to, analog hardware, digital hardware, firmware, software and/or combinations of each to perform one or more functions or actions. For example, based on a desired application or needs, logic may include a software controlled processor, discrete logic such as an application specific integrated circuit (ASIC), programmed logic device, or other processor.

"Computer" or "processor" as used herein includes, but is not limited to, any programmed or programmable electronic device or coordinated devices that can store, retrieve, and process data and may be a processing unit or a distributed processing configuration. Examples of processors include microprocessors, microcontrollers, graphics processing units (GPUs), floating point units (FPUs), reduced instruction set computing (RISC) processors, digital signal processors (DSPs), field programmable gate arrays (FPGAs), etc. Computer devices herein can have any of various configurations, such as handheld computers (e.g., so-called smart phones), pad computers, tablet laptop computers, desktop computers, and other configurations, and including other form factors. Logic may also be fully embodied as software.

"Software," as used herein, includes but is not limited to one or more computer readable and/or executable instructions that cause a processor or other electronic device to perform functions, actions, processes, and/or behave in a desired manner. The instructions may be embodied in various forms such as routines, algorithms, modules or programs including separate applications or code from dynamically linked libraries (DLLs). Software may also be implemented in various forms such as a stand-alone program, a web-based program, a function call, a subroutine, a servlet, an application, an app, an applet (e.g., a Java applet), a plug-in, instructions stored in a memory, part of an operating system, or other type of executable instructions or interpreted instructions from which executable instructions are created. It will be appreciated by one of ordinary skill in the art that the form of software is dependent on, for example, requirements of a desired application, the environment it runs on, and/or the desires of a designer/programmer or the like.

"Data storage device," as used herein, means a device for non-transitory storage of code or data, e.g., a device with a non-transitory computer readable medium.

"Non-transitory computer readable medium," as used herein, means any suitable non-transitory computer readable medium for storing code or data, such as a magnetic medium, e.g., fixed disks in external hard drives, fixed disks in internal hard drives, and flexible disks; an optical medium, e.g., CD disk, DVD disk, and other media, e.g., ROM, PROM, EPROM, EEPROM, flash PROM, external flash memory drives, etc.

FIG. 5 comprises another exemplary warm dimming LED circuit 500 similar in configuration to that of FIG. 4, but includes a current source control signal 502 which causes the constant current source 408 to reduce the current to both the first 402 and second 404 segment of LEDs.

An exemplary constant current regulator is the Shenzhen Sunmoon Micro SM2082D, however, similar controllable constant current regulators can be used in other exemplary embodiments. The current source control signal 502 is applied in conjunction with the first control signal 412 such that the second segment of LEDs 404 is caused to dim concurrently with (or independently of) the first segment 402.

FIG. 6 illustrates still another exemplary warm dimming LED circuit 600 comprising a first 402 and second 404 segment of LEDs electrically connected in series between a voltage source 406 and a constant current source 408; and a first differential circuit LED segment controller 410 configured to illuminate and independently dim the first segment of LEDs by diverting current from the first segment of LEDs in response to a first control signal 412. The circuit 600 of FIG. 6 differs from the circuits 400, 500 in that it includes a second differential circuit LED segment controller 602 that is configured to illuminate and independently dim the second segment of LEDs 404 in response to a second control signal 604. Thus, a second differential circuit LED segment controller 602 can be used to control the second segment of LEDs 404 rather than a controllable constant current source as was illustrated in FIG. 5. In some exemplary embodiments, the first control signal 412 and the second control signal 604 are the same signal, e.g., in a circuit where the two dimming circuits 410, 602 respond to the dimming control signal with a different dimming response (e.g., FIGS. 9 and 11).

FIG. 7 shows yet another exemplary warm dim circuit 700. FIG. 7 adds to FIG. 6 a third segment of LEDs 702 and a third dimming control signal 502 to the warm dimming LED circuit of FIG. 5. The constant current source 408 is controlled by dimming control signal 502 which functions as a current source control signal, as explained above, i.e., the control signal 502 controls the current to all three strings of LEDs 402, 404, 702. In exemplary embodiments, this control signal 502 is applied in conjunction with the control signals 412, 602 such that the third string of LEDs 702 is caused to dim concurrently with (or independently of) LED strings 402, 404.

Figure 8:
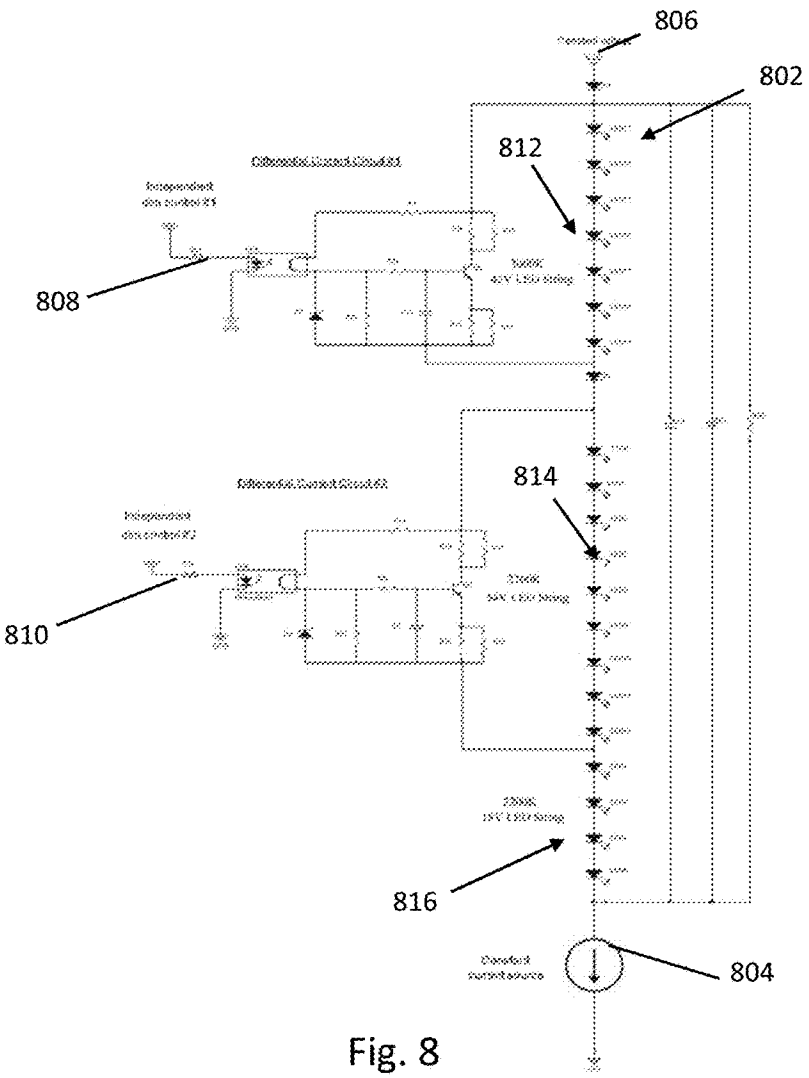
FIG. 8 is a circuit diagram of a LED light output regulation circuit according to an exemplary embodiment of the invention.

FIG. 8 presents an exemplary circuit implementation of the circuit 600 of FIG. 7 (without the third control signal 502) for controlling color temperature and brightness of an LED fixture when an LED string 802 is placed in series with a primary constant current source 804. The circuit further comprises a voltage (Vcc) 806 applied to a string of LEDs 802 (LED 0 to LED 20) in series with the constant current source 804 and two differential current circuits 808 and 810. In exemplary embodiments, the constant current source 804 is implemented with a constant current regulator. An exemplary constant current regulator for such a circuit is the Shenzhen Sunmoon Micro SM2082D, however, similar controllable constant current regulators can be used in other exemplary embodiments.

The LED string in this embodiment has three subsets 812, 814, 816, where each subset of an LED string having one or more LEDs connected electrically in series may be referred to individually as "segments" of the complete LED string 802. As illustrated, the two differential circuits 808 and 810 are place in parallel with two independent LED string segments 812, 814, respectively, with different forward voltages. It should be noted that the differential current circuits 808 and 810 can be placed at any locations along the LED string 802 in order to achieve a desired lighting effect. Additional differential circuits like circuit 808 and 810 can be added if more control over the LEDs 802 is desired. In the illustrated embodiment, the forward voltage of a segment of the LED string 802 is defined by the transistor and series resistor of the differential current circuit 808. FIG. 8 is a simplified representation of an exemplary embodiment (simplified in the sense that it does not show some aspects that one of ordinary skill in the art will be able to provide, e.g., a controller, circuitry to generate Vcc, a user interface and/or communication circuitry, etc., all not shown). As such, in other exemplary embodiments, each differential current circuit 808 and 810 can function with more than one LED string segment in parallel.

For the LED segment controller topology shown in FIG. 8, setting the control voltage of both differential current circuits 808 and 810 to zero would result no current flow through the differential current circuits. As a result, the current would flow through the LED segments 812 and 814 and the LED fixture would be at full brightness and producing a color temperature of about 2700K (based on color temperature mixture of LEDs shown in FIG. 12). Keeping the control voltage of the second differential current circuit 810 at zero, and beginning to linearly apply a control voltage to the first differential current control circuit 808 would result in the LED light output begin to decrease and color temperature to change due to the current through the second LED segment 814 (3000K) being decreased. As the control voltage of the first differential current control circuit 808 approaches its maximum value (defined by differential current circuit component selection), the current through the 3000K LEDs will approach zero, resulting in only the second segment 814 (2700K) and third segment 816 (2200K) LEDs to be fully ON. At this point by holding the control voltage of the differential current circuit 808 at its maximum, and beginning to apply a second linear control voltage to the differential current circuit 810, the LED fixture's brightness will continue to decrease and the color temperature will continue to change since the current through the second segment 814 (2700K) will be decreasing. As the control voltage of the differential current circuit 810 approaches its maximum value (defined by differential current circuit component selection), the current through the second segment 814 LEDs will approach zero, resulting in only the third segment 816 LEDs to be fully ON.

Figure 9:
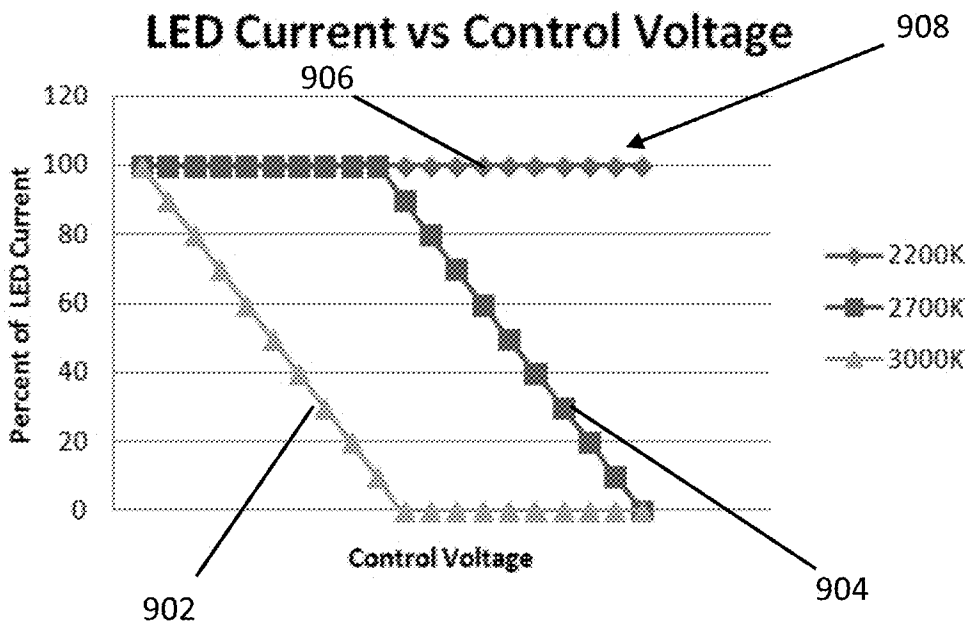
FIG. 9 is diagram of the current in three segments of LEDs according to an exemplary embodiment.

FIG. 9 illustrates the percent of LED current (light output) of the LEDs in FIG. 8. The first segment of LEDs 812, (represented by 902 in FIG. 9), the second segment of LEDs 814, (represented by 904 in FIG. 9), and the third segment of LEDs 816, (represented by 906 in FIG. 9) in relation to control signals applied to the differential circuit LED segment controllers (808 and 810) applied to control the first segment 812 and the second segment 814 of LEDs. As the control voltage increases, the first segment of LEDs 812 dims, (represented by 902 in FIG. 9) and then the second segment of LEDs 814 dims (represented by 904 in FIG. 9). It should be noted that the particular exemplary embodiment of FIG. 8 does not allow for control of the third segment of LEDs 816 (non-dimming operation of which is illustrated at 908). As will be noted, the illustrated exemplary embodiment demonstrates that the light output of the first segment 902 and the second segment 904 can be reduced from one hundred percent to zero percent. As is described herein, this independent control of each segment can be used to shift the color temperature of the LED fixture such that a warm dimming effect can be achieved in an LED lighting fixture.

Figure 10:
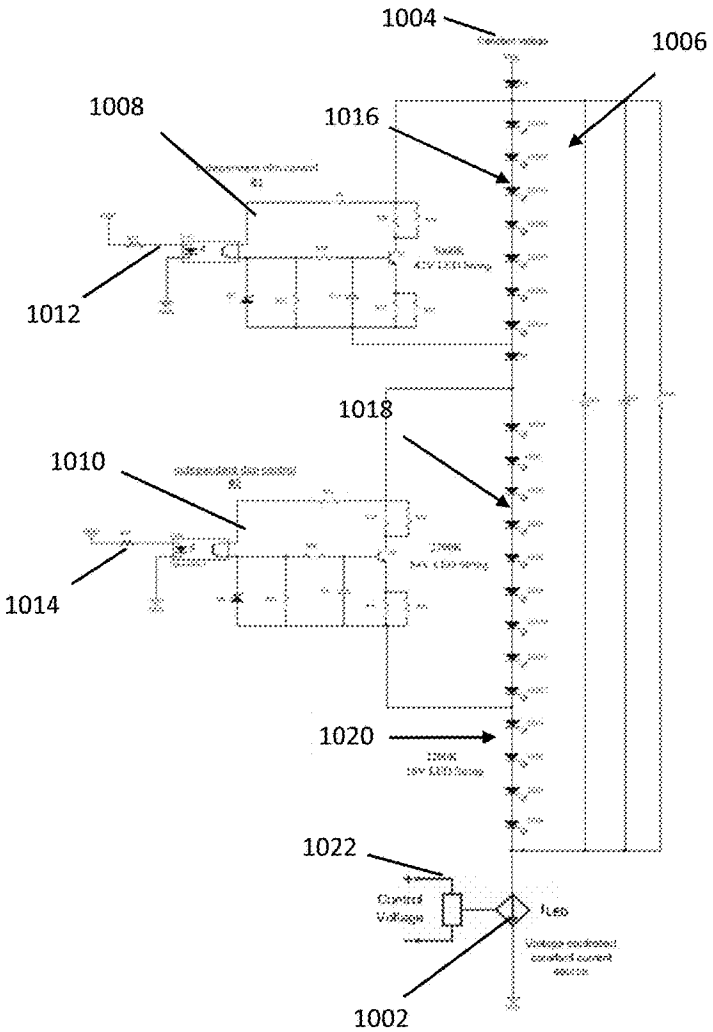
FIG. 10 is a circuit diagram of a LED light output regulation circuit according to an exemplary embodiment of the invention.

FIG. 10 presents an exemplary circuit implementation of the circuit 600 of FIG. 7 for controlling color temperature and brightness of an LED fixture when all LEDs are placed in series with a voltage controlled constant current source 1002. The circuit comprises a voltage (Vcc) 1004 applied to a string of LEDs 1006 (LED 0 to LED 20) in series with the voltage controlled current source 1002 and a first differential current control circuit 1008 and a second differential current control circuit 1010. The LED string in this embodiment has three segments 1016, 1018, and 1020. In an exemplary embodiment, the voltage controlled constant current source 1002 is implemented with a constant current regulator. An exemplary constant current regulator for such a circuit is the Shenzhen Sunmoon Micro SM2082D, however, similar controllable constant current regulators can be used in other exemplary embodiments. By varying the control voltage for the voltage controlled constant current source 1002, one can control the total current through the circuit and, as a result, brightness of the LED fixture. As the current of the voltage controlled constant current 1002 is varied, the total current through the fixture is varied. Combining this with control of the first differential current control circuit 1008 and a second differential current control circuit 1010 results in the ability to manipulate the color temperature and/or further affect the brightness of the LED Fixture. Thus, as illustrated in FIG. 10, the two differential circuits are placed in parallel with two independent LED string segments having different forward voltages. Additional differential circuits like circuit 1008 and 1010 can be added if more control over the LEDs 1006 is desired.

Conventional LED dimming can be achieved using the LED dimming configuration shown in FIG. 10. For example, if the total current through the system is linearly decreased by adjusting the current through the voltage controlled current source and this was done while setting the control voltage of both independent differential current control circuits to zero, the LED output would be decrease in brightness but maintain a color temperature of 2700K (based on LED configuration shown in FIG. 10).

However, if the total current through the system is linearly decreased by adjusting the current through the voltage controlled constant current source 1002 while keeping the control voltage 1014 of the second differential current control circuit 1010 at zero, and, at the similar linear rate as the voltage controlled constant current source 1002, apply a first control voltage 1012 to the first differential current control circuit 1008, the output of the LED string 1006 would decrease and color temperature would begin to change due to the current through the first LED segment 1016 (3000K) being decreased. As the control voltage 1012 of the first differential current control circuit 1008 approaches its maximum value (defined by differential current circuit component selection), the current through the first LED segment 1016 (3000K) will approach zero, resulting in only the second LED segment 1018 (2700K) and the third LED segment 1020 (2200K) LEDs being illuminated. While maintaining the first control voltage 1012 at its maximum value, a second control voltage 1014 is applied to the second differential current control circuit 1010. As this second control voltage 1014 reaches its maximum, the LED fixture's brightness will be decreased while the color temperature would begin to be warmer as the result of the second LED segment 1018 decreasing in brightness, leaving the third LED segment 1020 illuminated. As the second control voltage 1014 approaches it maximum value (defined by differential current circuit component selection), the current through the second LED segment 1018 (2700K) will approach zero, resulting in only the third LED segment 1020 (2200K) remaining fully illuminated. Continued dimming may be achieved by reducing the control voltage 1022 to the voltage controlled constant current source 1002 with the result being that the third LED segment 1020 continues to dim until the LED fixture has reached its maximum level of dimming.

Figure 11:
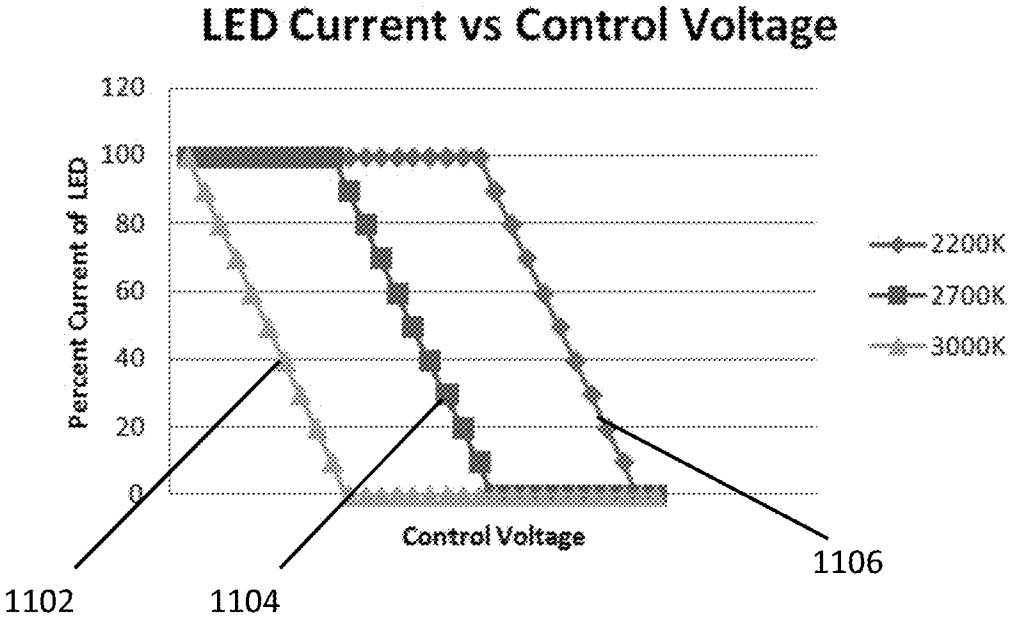
FIG. 11 is diagram of the current in three segments of LEDs according to an exemplary embodiment.

FIG. 11 illustrates the percentage of LED current (light output) of the LEDs of FIG. 10 as the control voltages are adjusted as described in the previous paragraph. As illustrated, the light output of the first LED segment 1016 (represented by 1102 in FIG. 11), the second LED segment 1018 (represented by 1104 in FIG. 11), and the third LED segment 1020 (represented by 1106 in FIG. 11) decrease in intensity as the various control voltages are applied. As will be described herein, this independent control of each segment can be used to shift the color temperature of the LED fixture such that a warm dimming effect can be achieved in a LED lighting fixture.

In some exemplary embodiments, warm dimming is achieved by combining three separate warm white LED segments as illustrated in the exemplary embodiment of FIG. 10. As is shown, each has a different color temperature. In order to achieve warm dimming, a LED segment with the coolest color temperature is dimmed first, followed by the next coolest segment until the warmest segment is dimmed.

While the present invention and associated inventive concepts have been illustrated by the description of various embodiments thereof, and while these embodiments have been described in considerable detail, it is not the intention of the Applicant to restrict or in any way limit the scope of the appended claims to such detail. Additional advantages and modifications will readily appear to those skilled in the art. For example, although the exemplary embodiments pertain to warm dimming, the differential current circuits can be used for other dimming of LEDs, such as constant color dimming or even cool dimming. As another example, dimming can be done in response to any of a number of different inputs, e.g., user input via a user interface (with associated user interface circuitry in the circuit and associated code in the control unit), user input via a communications link, such as BLE (with associated user communications circuitry in the circuit and associated code in the control unit), or other inputs, such as light sensors to dim as ambient light gets dimmer (with associated light intensity sensor circuitry in the circuit and associated code in the control unit). Moreover, in some instances, elements described with one embodiment may be readily adapted for use with other embodiments. Therefore, the invention, in its broader aspects, is not limited to the specific details, the representative apparatus, and illustrative examples shown and described. Accordingly, departures may be made from such details without departing from the spirit or scope of the general inventive concepts.

What is claimed is:

1. A warm dim LED circuit, comprising:

a. at least first and second pluralities of LEDs all electrically connected in series between a voltage source and a constant current source;

b. a dimmable LED segment controller configured to illuminate and independently dim the first plurality of LEDs; and c. a control unit coupled to the dimmable LED segment controller and programmed to dim the first plurality of LEDs relative to the second plurality of LEDs; and d. wherein the dimmable LED segment controller comprises a first differential current circuit connected in parallel with the first plurality of LEDs to dim the first plurality of LEDs by diverting current from the first plurality of LEDs in response to a first control signal from the control unit.

2. The warm dim LED circuit according to claim 1 wherein the constant current source reduces the current to the first and second pluralities of LEDs together in response to a current source control signal from the control unit to dim the first and second pluralities of LEDs.

3. The warm dim LED circuit according to claim 2, wherein the control unit reduces the current to the first plurality of LEDs before the control unit reduces the current to the second plurality of LEDs.

4. The warm dim LED circuit according to claim 1 wherein the dimmable LED segment controller comprises a second differential current circuit connected in parallel with the second plurality of LEDs to dim the second plurality of LEDs by diverting current from the second plurality of LEDs in response to a second control signal from the control unit.

5. The warm dim LED circuit according to claim 4 wherein the constant current source reduces the current to the first and second pluralities of LEDs together in response to a current source control signal from the control unit to dim the first and second pluralities of LEDs.

6. The warm dim LED circuit according to claim 5, wherein the control unit reduces the current to the first plurality of LEDs before the control unit reduces the current to the second plurality of LEDs.

7. The warm dim LED circuit according to claim 2, further comprising a third plurality of LEDs that are connected electrically in series with the first and second plurality of LEDs, wherein the constant current source reduces the current to the first, second, and third plurality of LEDS in response to a current source control signal form the control unit to dim the first, second, and third string of LEDs.

8. The warm dim LED circuit according to claim 7, wherein the pluralities of LEDs are physically arranged in concentric rings or concentric loci.

9. The warm dim LED circuit according to claim 7, wherein the dimmable LED segment controller comprises a second differential current circuit connected in parallel with the second plurality of LEDs to dim the second plurality of LEDs by diverting current from the second plurality of LEDs in response to a second control signal from the control unit.

10. The warm dim LED circuit according to claim 9, wherein the control unit reduces the current to the first plurality of LEDs before the control unit reduces the current to the second plurality of LEDs and the control unit reduces the current to the second plurality of LEDs before the control unit reduces the current to the third plurality of LEDs.

11. The warm dim LED circuit according to claim 10, wherein the first plurality of LEDs is comprised of LEDs selected from a color temperature range that is cooler than the color temperature range of the second plurality of LEDs and the second plurality of LEDs is comprised of LEDs selected from a color temperature range that is cooler than the color temperature range of the third plurality of LEDs.

12. The warm dim LED circuit of according to claim 7, wherein the first plurality of LEDs comprises LEDs with a color temperature of about 3000 k, the second plurality of LEDs comprises LEDs with a color temperature of about 2700 k, and the third plurality of LEDs comprises LEDs with a color temperature of about 2200 k.

13. A method of warm dimming a string of LEDs, the method comprising:

providing a string of LEDS arranged in a plurality of segments, including at least a first segment and a second segment, where the LEDs that form each segment are selected from LEDs that have substantially similar color temperatures, the first segment having a color temperature that is cooler than that of the color temperature of a second segment;

providing a voltage source in electrical connection with the string of LEDs;

providing an adjustable constant current source connected electrically in series with the string of LEDs;

arranging a first differential current regulation circuit such that it is connected in parallel to the first segment of LEDs;

providing a first control signal to the first differential current regulation circuit such that the first segment of LEDs is caused to dim in brightness by diverting current from the first segment of LEDs in response to the first control signal; and providing a current control signal to the adjustable constant current source which causes the adjustable constant current source to reduce current that passes through the string of LEDs.

14. The method of claim 13, further comprising the step of:

arranging a second differential current regulation circuit such that it is connected in parallel to the second segment of LEDs; and proving a second control signal to the second differential current regulation circuit such that the second segment of LEDs is caused to dim in brightness by diverting current from the first segment of LEDs in response to the second control signal.

15. The method of claim 14, wherein the first control signal and the second control signal are the same.

16. The method of claim 14, further comprising providing a third segment of LEDs that is warmer in color temperature than that of the second segment of LEDs.

17. The method of claim 16, further comprising the steps, in order, of:

adjusting the first control signal to cause the first segment of LEDs to dim in brightness such that they produce no visible light;

after adjusting the first control signal, adjusting the second control signal to cause the second segment of LEDs to dim in brightness such that they produce no visible light; and after adjusting the second control signal, adjusting the current control signal to reduce the current through the string of LEDs such that the light produced by the string of LEDs is reduced to a predetermined minimum level.

18. The method of claim 16, further comprising:

selecting the first segment of LEDs from LEDs with a color temperature of about 3000 k, selecting the second segment of LEDs from LEDs with a color temperature of about 2700 k; and selecting the third segment of LEDs from LEDs with a color temperature of about 2200 k.

19. A warm dim LED circuit, comprising:

a. a first, second, and third plurality of LEDs, each plurality comprising LEDs that are substantially the same color temperature, where the color temperature of the first plurality of LEDs is cooler than that of the second plurality and the color temperature of the second plurality is cooler than that of the third plurality, the pluralities arranged in a series electrical configuration;

b. a voltage source connected to a first end of the series configuration of the pluralities;

c. a constant current source connected such that it regulates the current flow through the plurality of LEDs, the constant current source configured such that a current control signal being applied causes the regulated current through the plurality of LEDs to be reduced;

d. a first differential current circuit connected in parallel with the first plurality of LEDs and configured such that a first control signal applied to the first differential current circuit causes current to be diverted from the first plurality of LEDs;

e. a second differential current circuit connected in parallel with the second plurality of LEDs and configured such that a second control signal applied to the second differential current circuit causes current to be diverted from the second plurality of LEDs;

f. a dimming controller electrically connected to the first and second differential current circuits and also electrically connected to the constant current source that provides the current control signal, the first control signal, and the second control signal; and g. an algorithm that when performed, causes the dimming controller to perform the following steps in order:

i. causing the first control signal to be applied until there is substantially no current flowing through the first plurality of LEDs;

ii. causing the second control signal to be applied until there is substantially no current flowing through the second plurality of LEDs; and ii. causing the current control signal to be applied until the current flowing through the first, second, and third plurality of LEDs is reduced.

20. The warm dim LED circuit according to claim 19, wherein the pluralities of LEDs are physically arranged in concentric rings or concentric loci.

* * * * *